US009103619B2

(12) United States Patent
Chia

(10) Patent No.: US 9,103,619 B2
(45) Date of Patent: Aug. 11, 2015

(54) SQUIRTING TOY INCLUDING A DYNAMO SYSTEM AND METHODS THEREOF

(71) Applicant: Easebon Services Limited, Kwun Tong (HK)

(72) Inventor: Francis See Chong Chia, Kowloon (HK)

(73) Assignee: EASEBON SERVICES LIMITED, Kwun Tong (HK)

( * ) Notice: Subject to any disclaimer, the term of this patent is extended or adjusted under 35 U.S.C. 154(b) by 189 days.

(21) Appl. No.: 13/788,017

(22) Filed: Mar. 7, 2013

(65) Prior Publication Data

US 2014/0252035 A1 Sep. 11, 2014

(51) Int. Cl.

| | |
|---|---|
| ***A63H 3/18*** | (2006.01) |
| ***F41B 9/00*** | (2006.01) |
| ***F41G 1/35*** | (2006.01) |

(52) U.S. Cl.

CPC ..... *F41B 9/0037* (2013.01); *F41B 9/0078* (2013.01); *F41G 1/35* (2013.01)

(58) Field of Classification Search

CPC ..... B65D 5/66; A63H 5/04; A63H 3/18

USPC ..... 222/78–79, 39, 113, 333–334, 222/522–525, 386, 547–548, 183, 192; 446/405; 362/111–112

See application file for complete search history.

(56) References Cited

U.S. PATENT DOCUMENTS

| | | | | |
|---|---|---|---|---|
| 4,239,129 | A * | 12/1980 | Esposito | 222/79 |
| 4,289,971 | A * | 9/1981 | Ueda | 290/52 |
| 6,291,900 | B1 * | 9/2001 | Tiemann et al. | 290/1 A |
| 7,147,428 | B2 * | 12/2006 | Lamont | 415/1 |
| 2008/0121652 | A1 * | 5/2008 | Orlowski et al. | 222/79 |
| 2009/0145925 | A1 * | 6/2009 | Wegelin | 222/113 |
| 2012/0018449 | A1 * | 1/2012 | Chia | 222/79 |
| 2012/0302126 | A1 * | 11/2012 | Yu et al. | 446/57 |

* cited by examiner

*Primary Examiner* — Paul R Durand
*Assistant Examiner* — Andrew P Bainbridge
(74) *Attorney, Agent, or Firm* — Amster, Rothstein & Ebenstein, LLP

(57) ABSTRACT

A squirting toy capable of squirting water received from a reservoir and/or from an external source. The squirting toy can include a housing, a piston, a shaft, and an handle portion. As the piston is slidably moved through the housing the water can be squirted out of the housing. Further, as the piston is slidably moved through the housing an electrical assembly including a turbine can be activated generating electricity to power an electric device (e.g., a light).

26 Claims, 14 Drawing Sheets

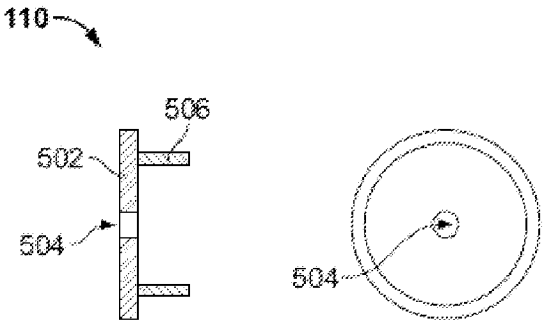
FIG. 5A
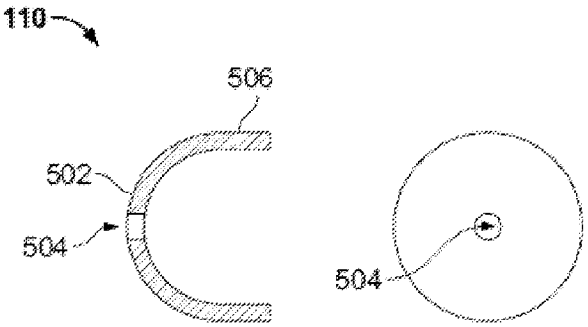
FIG. 5B
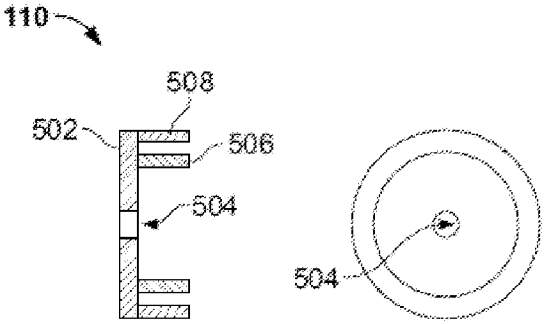
FIG. 5C
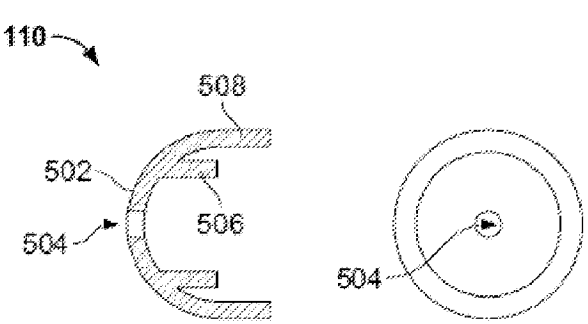
FIG. 5D
FIG. 5

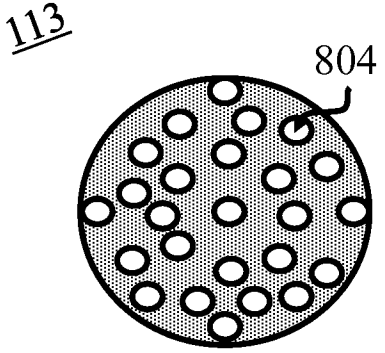
FIG. 8A
FIG. 8B
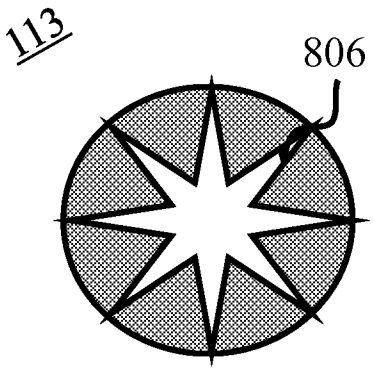
FIG. 8C
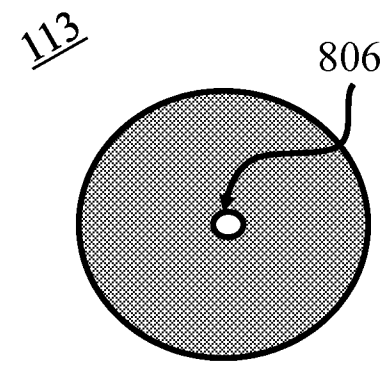
FIG. 8D

SQUIRTING TOY INCLUDING A DYNAMO SYSTEM AND METHODS THEREOF

FIELD OF THE INVENTION

The present invention relates to a squirting toy capable of converting the squirting toy's user driven fluid flow from mechanical energy to electrical energy prior to exhausting the fluid from the squirting toy.

BACKGROUND

Squirt guns are well known in many forms in the prior art. Numerous squirt guns and squirting toys are made and have been made over the years for use by persons while swimming in or standing adjacent to a swimming pool, which are adapted to quickly take in water from the swimming pool for squirting. One such toy is called MAX LIQUIDATOR™ and is sold by Prime Time Toys Ltd. This toy, representative of many such squirting toys, is basically comprised of a housing having a nozzle at its squirting end. A piston, which includes a graspable handle, is adapted to slide within the housing so that, when the nozzle end of the housing is submerged in the pool and the piston is pulled backwards, water is drawn into the housing through the nozzle. And when the piston is subsequently forced forwardly, that water is forced from the housing, through the nozzle, towards a target, in a powerful stream.

Additionally, many squirt guns of the prior art are constructed in a manner that entraps air and thereby inadvertently enables those guns to partially float in water, but do not float when no air is entrapped. The degree of such buoyancy is relative to the amount of water that has been taken into the gun and the longevity of such buoyancy is relative to the amount of air leakage from the housing.

There are also floating toy "swimming noodles" in the prior art, which are made of resilient floating closed-cell polymer foam. These toys are used to provide buoyancy to the user while swimming. Because these toys are often left floating in the pool when not in use, their softness eliminates the safety threat that they would otherwise pose.

Further, some have produced squirting toys that illuminate or make sounds when activated. Generally speaking, these toys utilize energy stored in batteries to power the illuminating or sound making device when, for example, a user depresses a button or trigger. For example, see U.S. Pat. No. 4,239,129 to Esposito "Esposito" and U.S. Patent Publication No. 2009/0247043 to Liao "Liao", the contents of both of which are incorporated herein in their entireties. However, as the batteries lose power illumination or sound making tends to decrease and eventually fails to work without replacement of the batteries. These systems also require wiring and other electronics offset from the batteries which can fail when exposed to moisture.

Liao further discloses a squirting toy that connects to a hose. When connected to a hose a water driven generator module connected to a water channel receives the flowing water from the hose and thereby generates electricity for an electronic device. Liao's squirting toy is thereby restricted for use by the range of the hose (tether) since electricity can only be generated when the squirting toy receives water from the hose.

SUMMARY OF THE INVENTION

In exemplary embodiments, a squirting toy can include a housing having a chamber. The housing can include an interior surface and an exterior surface, a first end comprising an opening, and/or a second end comprising an opening. The squirting toy can also include a piston slidably engaged with the interior surface of the housing and connected to a shaft, the shaft extending from the second end of the housing and including a handle portion external to the housing. Further, the piston can be adapted for longitudinal movement within the chamber to decrease and increase the volume of the chamber such that water can be inhaled through the first end when the volume increases and exhaled through the first end when the volume decreases. The squirting toy can also include a soft non-water-absorbing shell disposed over a portion of the external surface of the housing. Further, in exemplary embodiments, the squirting toy can include an electrical generating assembly that can power an electric device, wherein electricity can be generated by slidably moving the piston longitudinally within the chamber causing the water to power the electrical generating assembly.

In exemplary embodiments, the electrical generating assembly can further include a turbine assembly and a dynamo. Further, in exemplary embodiments, the electrical generating assembly can further include a water flow director that can have at least one guide vane that a fluid passes through. In exemplary embodiments, the water flow director can direct the flow of the water before interaction with the turbine assembly.

In exemplary embodiments, the water flow director can direct the flow of water into a spiral flow pattern.

In exemplary embodiments, slidably moving the piston along a length of the housing can cause fluid to interact with the turbine assembly and can thereby cause the turbine assembly to rotate and/or the dynamo to generate electricity.

In exemplary embodiments, the squirting toy can further include a turbulent control member; wherein the turbulent control member can reduce turbulent flow, increases laminar flow, and/or produces a more concentrated exit stream, from the squirting toy, that can be capable of traversing substantially far distances.

In exemplary embodiments, the turbulent control member can be a perforated plate, a screen member, and/or linear guidance walls.

In exemplary embodiments, the electric device can be a light source and/or noise generator.

In exemplary embodiments, the soft non-water-absorbing shell can provide buoyancy to keep the toy afloat in water when the housing is, for example, filled to its maximum capacity with water. further, in exemplary embodiments, the soft non-water absorbing shell can form a protective surface over at least a portion of the housing and/or the softness of the shell can offer safety benefits.

In exemplary embodiments, the soft non-water-absorbing shell can be disposed over substantially the entirety of the housing.

In exemplary embodiments, the squirting toy can further include a soft non-water-absorbing shell disposed over a portion of the handle portion.

In exemplary embodiments, the safety benefits can include softness and/or absence of hard edges.

In exemplary embodiments, an electrical generating assembly for a squirting toy, can include an electrical generating assembly powering an electric device, the electrical generating assembly can include a turbine assembly and a dynamo. Further, in exemplary embodiments, the electrical generating assembly can be coupled to a distal end of a housing of a squirting toy and/or a nozzle can be coupled to a distal end of the electrical generating assembly. The housing can have a chamber of variable volume, the volume can be varied by user driven force causing water to be inhaled and exhausted through the nozzle such that the water traverses the electrical generating assembly. In exemplary embodiments, electricity can be generated by water traversing the electrical generating assembly in response to the volume of the chamber being varied by the user.

In exemplary embodiments, the electrical generating assembly can further include a water flow director having an at least one guide vane that a fluid can pass through, wherein the water flow director can direct the flow of the water before interaction with the turbine assembly. Further, in exemplary embodiments, the water flow director can direct the flow of water into a spiral flow pattern.

In exemplary embodiments, the electrical generating assembly for a squirting can further include a turbulent control member that can reduce turbulent flow, increase laminar flow, and/or produces a more concentrated exit stream, from the squirting toy, capable of traversing substantially far distances. Further, in exemplary embodiments, the turbulent control member can be a perforated plate, a screen member, and/or linear guidance walls.

In exemplary embodiments, the electric device can be a light source and/or noise generator.

In exemplary embodiments, the housing can further include an external surface, an internal surface, a fluid flow end, and/or a shaft receiving end.

In exemplary embodiments, the volume of the chamber can increase, inhaling fluids through the nozzle, when a piston slidably engaged with the internal surface of the chamber moves in a first lateral direction towards the shaft receiving end. Further, in exemplary embodiments, the volume of the chamber can decrease, exhaling fluids through the nozzle, when the piston slidably engaged with the internal surface of the chamber moves in a second lateral direction towards the fluid flow end.

In exemplary embodiments, a soft non-water-absorbing shell can be disposed over a portion of the external surface of the housing. Further, in exemplary embodiments, the soft non-water-absorbing shell can further include providing buoyancy to keep the toy afloat in water when the housing is, for example, filled to its maximum capacity with water. In exemplary embodiments, the soft non-water absorbing shell can form a protective surface over at least a portion of the housing and/or the softness of the shell can offer safety benefits.

In exemplary embodiments, the soft non-water-absorbing shell can be disposed over substantially the entirety of the housing.

In exemplary embodiments, a soft non-water-absorbing shell can be disposed over a portion of the handle portion.

In exemplary embodiments, the safety benefits can include softness and/or absence of hard edges.

In exemplary embodiments, a water squirting toy having a housing can include a nozzle end and a variable volume chamber. The chamber volume can be varied by user driven force on a handle causing a piston to slidably traverse longitudinally within the chamber increasing and decreasing the volume of the chamber thereby causing water to be inhaled and exhausted through the nozzle of the water squirting toy. In exemplary embodiments, the improvement of the water squirting toy can be an electrical generating assembly that can power an electric device, wherein electricity can be generated by the piston slidably traversing longitudinally within the chamber causing the water to power the electrical generating assembly during at least one of inhalation and exhaustion of water from the squirting toy.

These and other features of this invention are described in, or are apparent from, the following detailed description of various exemplary embodiments of this invention.

BRIEF DESCRIPTION OF THE DRAWINGS

Exemplary embodiments of this invention will be described with reference to the accompanying drawings and figures:

FIGS. 5A-5D depict a nozzle element of the systems and methods of the present invention;

FIGS. 8A-8D depict a turbulent control member of the systems and methods of the present invention;

DETAILED DESCRIPTION OF THE EXEMPLARY EMBODIMENTS

Figure 1:
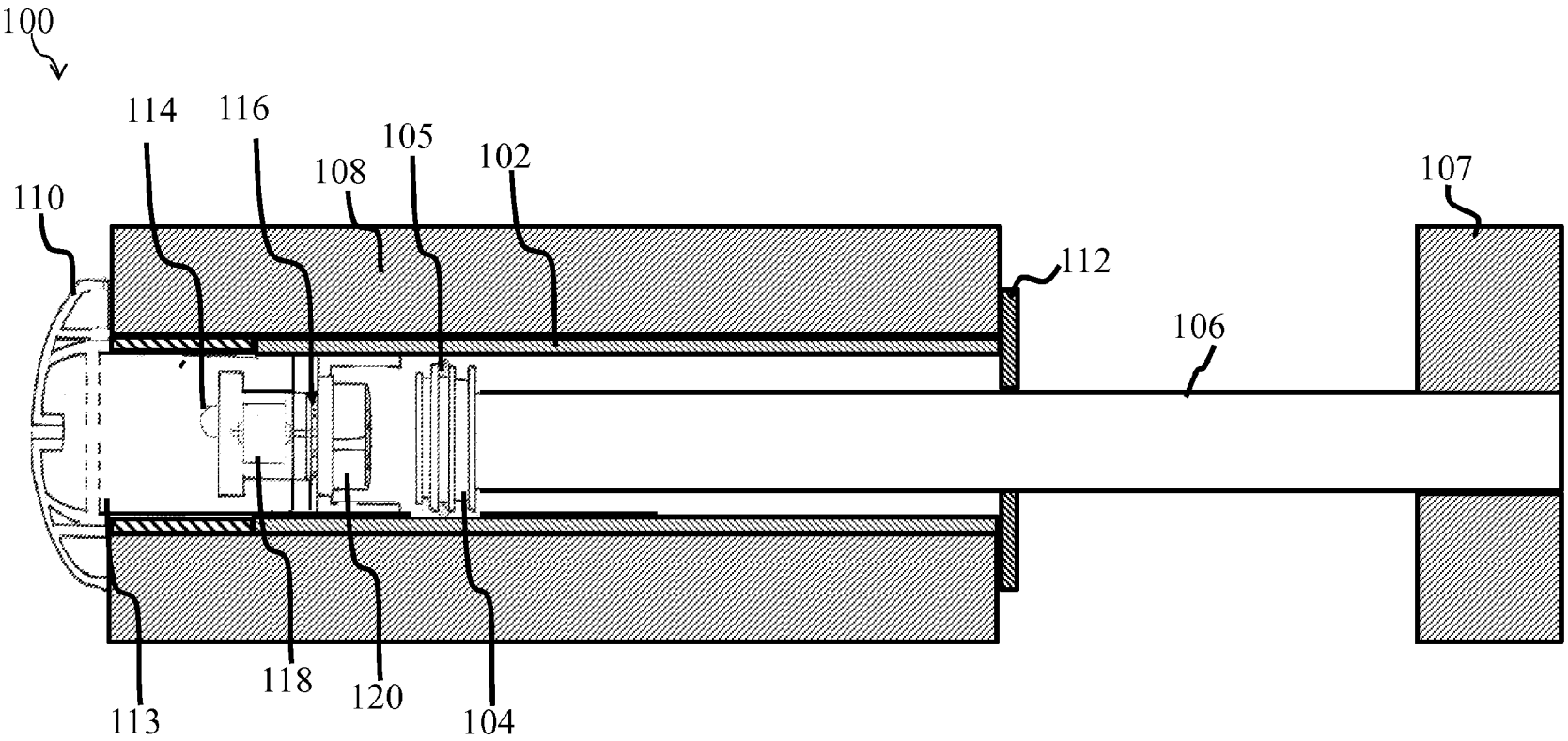
FIG. 1 depicts elements of a squirting gun of the present invention.

Referring to FIG. 1, in exemplary embodiments, a squirting toy 100 can include a housing 102 surrounding a piston 104, piston 104 can be attached to a shaft 106, and at least some portion of housing 102 can be surrounded by a shell 108. In exemplary embodiments, a nozzle 110 can be located at one end of the housing for accelerating water pushed by piston 104 inside housing 102 out of housing 102. In exemplary embodiments, a slide bushing 112 can be located at one end of the housing 102 that can retain piston 104 within housing 102. In exemplary embodiments, force can be applied to handle portion 107 causing piston 104 to displaceably move along the length of housing 102. Piston 104 can include one or more seals 105 (e.g., "o" rings, etc.).

In exemplary embodiments, squirting toy 100 can include a turbulent control member 113. Turbulent control member 113 can be used to decrease turbulent water flow and/or increase laminar water flow from the exit of nozzle 110. Turbulent control member 113 can be used to, for example, produce a more concentrated exit stream, from squirting toy 100, capable of traversing substantially far distances.

In exemplary embodiments, squirting toy 100 can include an electrical generating assembly that can power an electric device 114 such as, but not limited to, a light source and/or noise generator. The electrical generating assembly can include, but is not limited to, a turbine assembly 116 and a dynamo 118. In exemplary embodiments, the electrical generating assembly can be powered by a fluid displaced in response to user driven force applied to handle portion 107 causing piston 104 to displaceably move along the length of housing 102.

In exemplary embodiments, squirting toy 100 can include a water flow director 120 that can begin spiraling the fluid before interaction with turbine assembly 116. That is, water flow director 120 can direct the fluid flow on to turbine assembly 116. Directing the fluid flow can increase the efficiency of electricity generated by the electrical assembly. Further, in exemplary embodiments, blades of turbine assembly 116 can be shaped with a pitch and/or angle so that axial flow of the fluid passing the blades causes rotational movement of turbine assembly 116. For example, in some embodiments, water flow director 120 may not be required as blades of turbine assembly 116 can be shaped to cause rotational movement of turbine assembly 116. Of course, in some embodiments, water flow director 120 can be used in conjunction with blades of turbine assembly 116 to cause rotational movement of turbine assembly 116.

Figure 2:
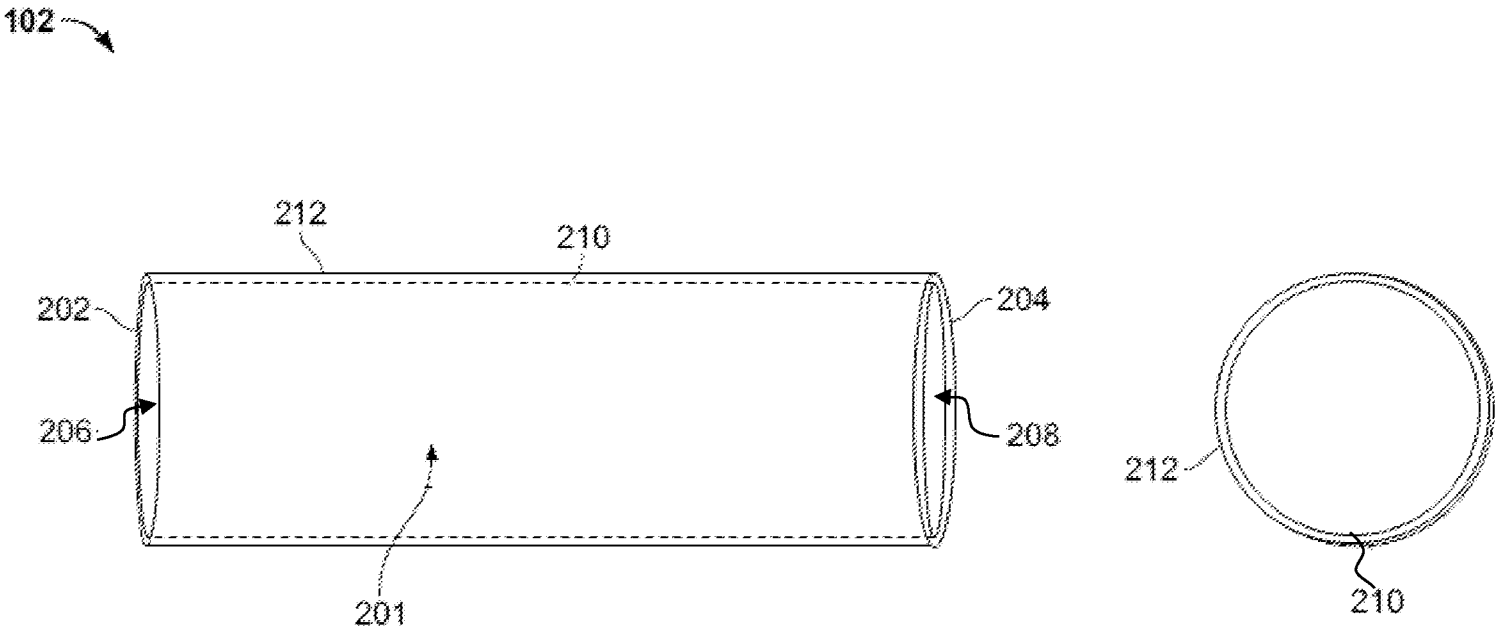
FIG. 2 depicts a housing element of the systems and methods of the present invention.

Referring to FIG. 2, in exemplary embodiments, housing 102 can be substantially cylindrical in shape and can have an opening passing from the first end of the housing to the second end of the housing. For example, housing 102 can be a substantially rigid tube that encloses a hollow cylindrical chamber.

In exemplary embodiments, housing 102 can include a first surface end 202 including an opening 206 and a second surface end 204 including an opening 208 and a material can extend from first surface end 202 to second surface end 204. As the material extends from first surface end 202 including opening 206 to second surface end 204 including opening 208, chamber 201 can be created such that housing 102 can include an internal surface 210 and an external surface 212.

In exemplary embodiments, opening 206 and opening 208 can be any reasonable shape, such as, but not limit to round, square, polygonal, triangular, star shaped, or any other reasonable shape for receiving piston 104 and/or a fluid (e.g., water). For ease, openings 206 and 208 are depicted as round, this is in no way meant to be a limitation. Further, chamber 201 connecting opening 206 and opening 208 can follow any desired path. For example, chamber 201 can change shape when connecting opening 206 and opening 208. By way of example, opening 206 and 208 may be square however the length of chamber 201 connecting the square openings can be substantially round.

In exemplary embodiments, housing 102 can have any reasonable cylindrical shape, such as, but not limited to, round cylindrical, square cylindrical, polygonal cylindrical, star cylindrical, triangular cylindrical, or any other reasonable cylindrical shape. For ease, each of the figures illustratively depicts housing 102 as having a round cylindrical shape, this is in no way meant to be a limitation.

In exemplary embodiments, internal surface 210 and external surface 212 can be substantially smooth and/or can be substantially rough. Internal surface 210 can be substantially smooth, for example, to ease the passage of piston 104 through the length of housing 102. External surface 210 can be substantially rough and/or substantially smooth, for example, to allow positioning (e.g., frictional positioning, etc.) of shell 108.

Figure 3:
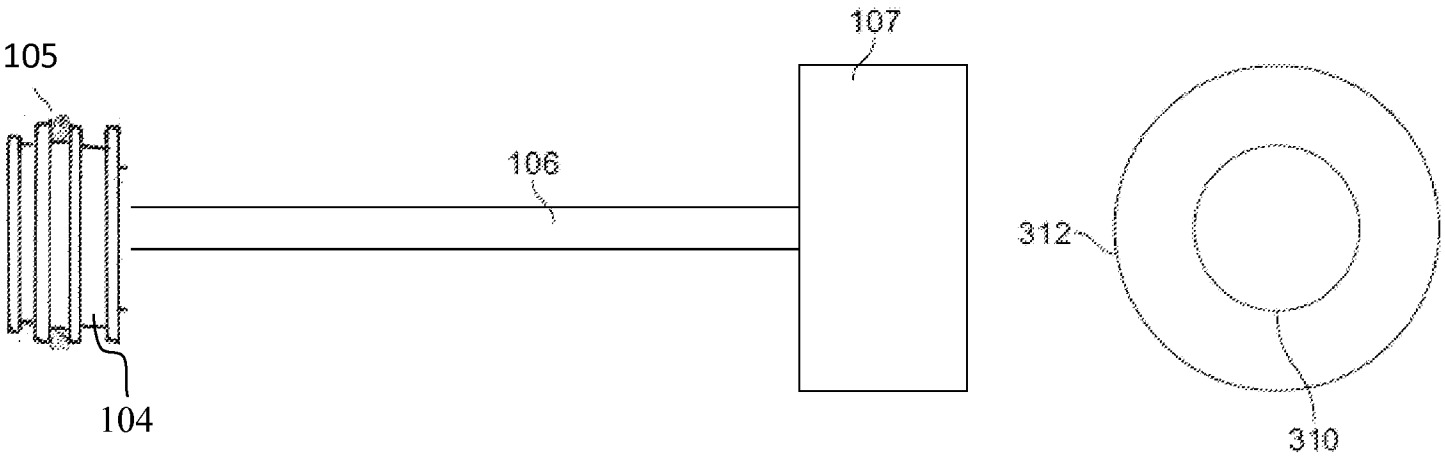
FIG. 3 depicts a piston, shaft, and a handle portion element of the systems and methods of the present invention.

Referring to FIG. 3, in exemplary embodiments, shaft 106, handle portion 107, and/or piston 104 can be substantially cylindrical in shape. In exemplary embodiments, shaft 106, handle portion 107, and/or piston 104 can be substantially solid, can be substantially tubular, and/or any combination thereof.

In exemplary embodiments, if shaft 106, handle portion 107, and/or piston 104 is tubular (e.g., has an opening passing through at least some of the length its body) the cross sectional shape of the internal surface (not shown) can be any reasonable shape, such as, but not limit to round, square, polygonal, triangular, star shaped, or any other reasonable shape. For ease, the cross sectional shape of shaft 106, handle portion 107, and/or piston 104 is depicted/described as round, this is in no way meant to be a limitation.

In exemplary embodiments, shaft 106, handle portion 107, and/or piston 104 can have any reasonable cylindrical shape, such as, but not limited to, round cylindrical, square cylindrical, polygonal cylindrical, star cylindrical, triangular cylindrical, or any other reasonable cylindrical shape. For ease, each of the figures illustratively depicts shaft 106, handle portion 107, and/or piston 104 as having a round cylindrical shape, this is in no way meant to be a limitation. In exemplary embodiments, shaft 106 can be substantially the same shape as piston 104 and/or handle portion 107. For example, shaft 106 and/or piston 104 can be round cylindrical having diameters substantially equal to each other and/or diameters different than each other. For ease, each of the figures illustratively depicts shaft 106 and piston 104 as round having different diameters, this is in no way meant to be a limitation.

In exemplary embodiments, handle portion 107 can include an external surface 312 designed to couple with the internal surface, discussed below, of a shell. For example, the cross sectional shape of external surface 312 and the internal surface of a shell can be substantially similar.

In exemplary embodiments, piston 104 can include an external surface 310 having a cross sectional shape substantially similar to the cross sectional shape of internal surface 210 of housing 102. By way of example, if the cross sectional shape of internal surface 210 is round having a diameter of 0.5 inches then the cross sectional shape of external surface 310 can be round having a diameter of just slightly smaller than 0.5 inches. In exemplary embodiments, piston 104 can include a seal 105 (e.g., an O-ring) designed to allow piston 104 to displaceable move within the length of housing 102 while forcing water out of housing 102.

In exemplary embodiments, shaft 106, piston 104, and/or handle portion 107 can include a coupling region. In exemplary embodiments, the coupling region can be located such that shaft 106 can be coupled to piston 104 and/or handle portion 107.

In exemplary embodiments, the coupling region of one component (e.g., shaft 106, piston 104, and/or handle portion 107) can be coupled to the coupling region of another component (e.g., shaft 106, piston 104, and/or handle portion 107) by inserting the coupling region of one component into the coupling region of another component. In exemplary embodiments, the coupling region of one component can remain coupled to the coupling region of another component by any reasonable interaction, such as, but not limited to, a mechanical interaction (e.g., thread interaction, frictional interaction, etc.), a chemical interaction (e.g., bonding, melting, etc.), an adhesive interaction (e.g., adhesively contacting the coupling regions), or any other reasonable interaction capable of coupling the coupling regions.

In exemplary embodiments, shaft 106, piston 104, and/or handle portion 107 can be substantially one unit. For ease, they are depicted as three separate elements, this is in no way meant to be a limitation.

Figure 4:
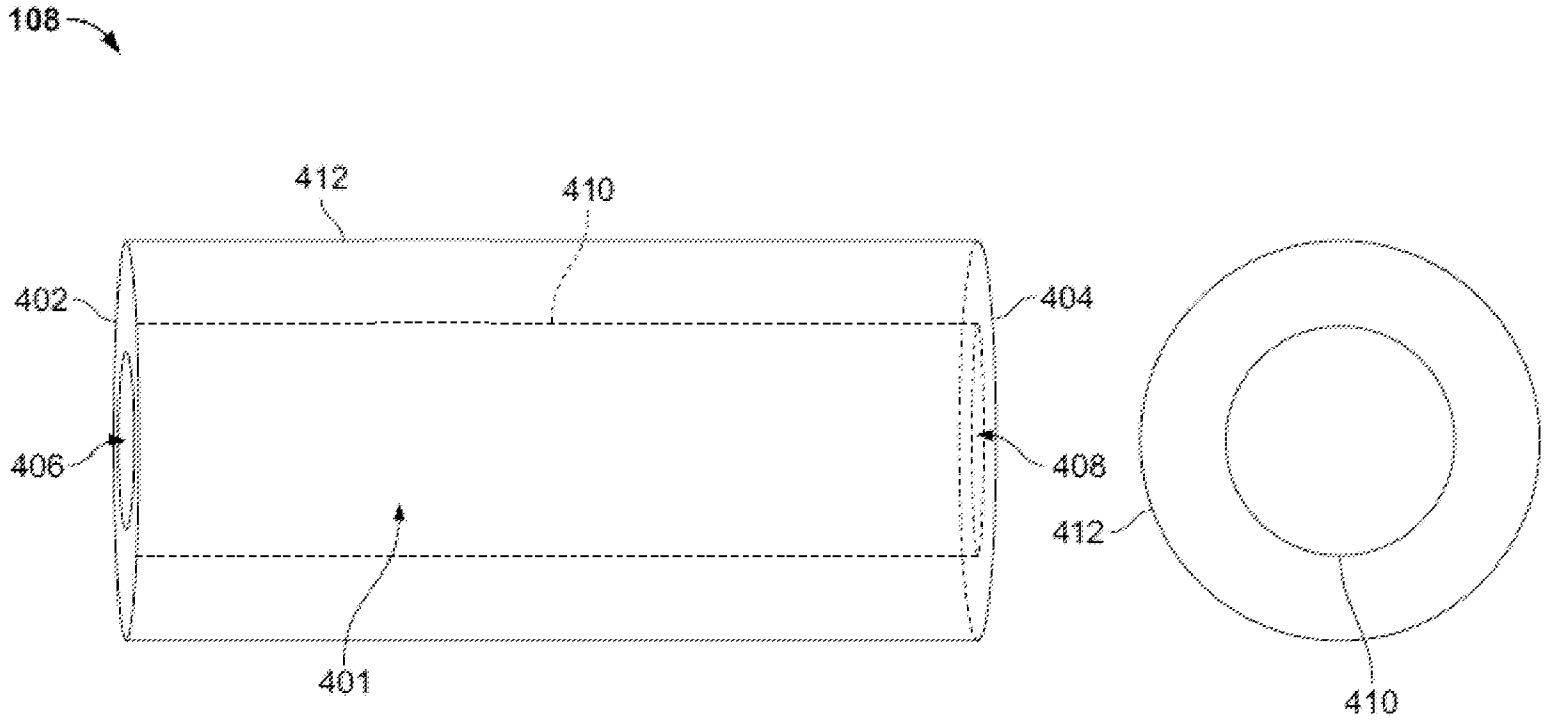
FIG. 4 depicts a shell element of the systems and methods of the present invention.

Referring to FIG. 4, in exemplary embodiments, shell 108 can be substantially cylindrical in shape and can have an opening passing from the first end of the shell to the second end of the shell. For example, shell 108 can be a tube.

In exemplary embodiments, shell 108 can include a first surface end 402 including an opening 406 and a second surface end 404 including an opening 408 and a material can extend from first surface end 402 to second surface end 404. As the material extends from first surface end 402 including opening 406 to second surface end 404 including opening 408, channel 401 can be created such that shell 108 can include an internal surface 410 and an external surface 412.

In exemplary embodiments, opening 406 and opening 408 can be any reasonable shape, such as, but not limit to round, square, polygonal, triangular, star shaped, or any other reasonable shape for receiving at least a region of housing 102 and/or handle portion 107. For ease, openings 406 and 408 are depicted as round, this is in no way meant to be a limitation. Further, channel 401 connecting opening 406 and opening 408 can follow any desired path. For example, channel 401 can change shape when connecting opening 406 and opening 408. By way of example, opening 406 and 408 may be square however the length of channel 401 connecting the square openings can be substantially round.

In exemplary embodiments, shell 108 can have any reasonable cross-sectional shape, such as, but not limited to, round cylindrical, square cylindrical, polygonal cylindrical, star cylindrical, triangular cylindrical, or any other reasonable cylindrical shape. For ease, each of the figures illustratively depicts shell 108 as having a round cylindrical shape, this is in no way meant to be a limitation.

In exemplary embodiments, internal surface 410 and external surface 412 can be substantially smooth and/or can be substantially rough. Internal surface 410 can be substantially smooth, for example, to ease the passage of housing 102 and/or handle portion 107 through a length of shell 108. External surface 240 can be substantially rough and/or substantially smooth, for example, to increase friction gripping for a user (e.g., a child with a wet hand).

In exemplary embodiments, shell 108 can be constructed of a substantially soft material such as, but not limited to, closed cell polyethylene foam. In exemplary embodiments, the substantially soft material can act as a protective surface. For example, the substantially soft material can minimize hard edges such that a child is less likely to injure themselves or another while using squirting toy 100. In exemplary embodiments, the substantially soft material can be substantially buoyant such that the squirting toy 100 can remain afloat in water, for example, even when housing 102 and/or a reservoir (not shown) is substantially filled with water. As squirting toy 100 can be substantially buoyant, squirting toy 100 may be substantially less difficult to lose while using and/or squirting toy 100 can be used to aide an individual (e.g., a child) who has difficulty staying afloat in water. In some embodiments, the toy will not sink to the bottom of a body of water. For example, because the toy will not sink in a pool the toy is less difficult and/or less dangerous for a child to retrieve.

In exemplary embodiments, shell 108 can extend at least some length of housing 102 and/or handle portion 107 such that, but not limited to, shell 108 can substantially encapsulate housing 102 and/or handle portion 107, shell 108 can encapsulate a region of housing 102 and/or handle portion 107, shell 108 can cover a portion of the external surface of housing 102 and/or handle portion 107, or any shell can cover and/or extend any reasonable amount of housing 102 and/or handle portion 107.

In exemplary embodiments, at least one shell 108 can be located on housing 102 and/or handle portion 107. For example, a first shell 108 can be located on housing 102 and a second shell 108 can be located on handle portion 107; a first shell 108 and a second shell 108 can be located on housing 102 and a third shell 108 can be located on handle portion 107; a first shell 108 and a second shell 108 can be located on housing 102 and a third shell 108 and fourth shell 108 can be located on handle portion 107; or any reasonable number of shells 108 can be located on housing 104 and/or handle portion 107. Further, shell 108 can have the same or different cross-sectional shapes and/or the same or different diameters or outermost dimensions. Further still, the length of shell 108 can vary, for example, such that one or more shells can extend some of and/or the entire length of housing 102.

Referring to FIGS. 5A-D, in exemplary embodiments, nozzle 110 can include a body 502 (e.g., a cap, end cap, etc.) including an opening 504 such that water can be accelerated out of housing 102. Referring to FIGS. 5A-5B, in exemplary embodiments, nozzle 110 can include substantially one dimensional (e.g., flat, planar, etc.) and/or two dimensional (e.g., curved, rounded, pyramidal, etc.) body 502 including protrusions 506 that can be coupled to shell 108 and/or housing 102. Referring to FIGS. 5C-5D, in exemplary embodiments, nozzle 110 can include substantially one dimensional (e.g., flat, planar, etc.) and/or two dimensional (e.g., curved, rounded, pyramidal, etc.) body 502 including protrusions 506 that can be coupled to shell 108 and/or housing 102 and protrusions 508 that can be coupled to shell 108 and/or housing 102. In exemplary embodiments, opening 504 can have a cross sectional size of about 2 millimeters to 8 millimeters. It will be understood that nozzle 110 and housing 102 can be substantially one unit.

Figure 6:
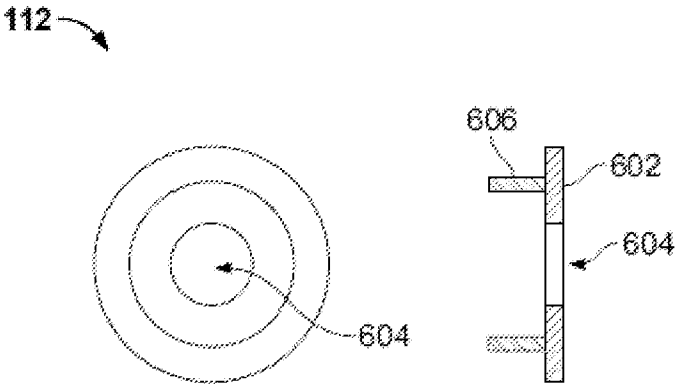
FIG. 6 depicts a slide bushing element of the systems and methods of the present invention.

Referring to FIG. 6, in exemplary embodiments, a slide bushing 112 located at one end of the housing 102 can retain piston 104 within housing 102 and reduce leakage of water out of housing 102. Slide bushing 112 can include a body 602 that can include an opening 604 for slidably receiving shaft 106 and can include protrusions 606 that can be coupled to housing 102 and/or shell 108. In exemplary embodiments, a seal (e.g., an o-ring) can be located on slide bushing 112 to further reduce leakage of water out of housing 102. It will be understood that slide bushing 112 and housing 102 can be substantially one unit.

Figure 7A:
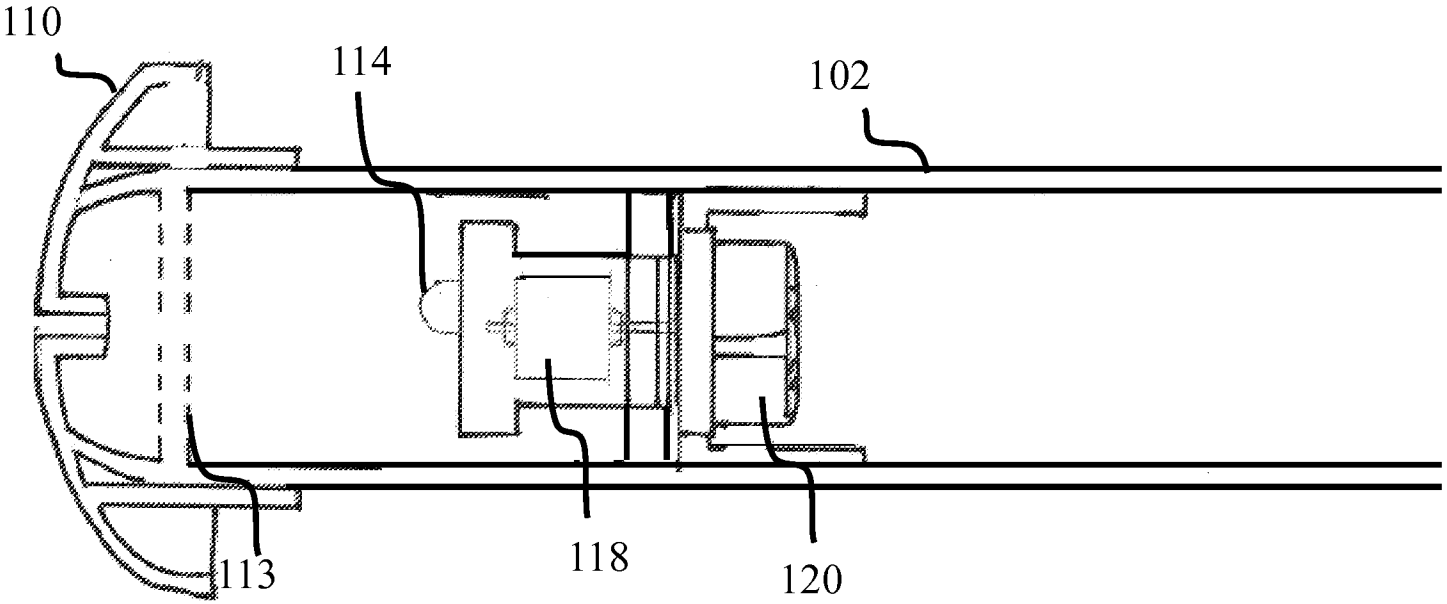
FIGS. 7A-7D depict a turbulent control member, electrical assembly, electric device, and water flow director and/or subassemblies of the systems and methods of the present invention in various assembled and partially assembled configurations.
Figure 7B:
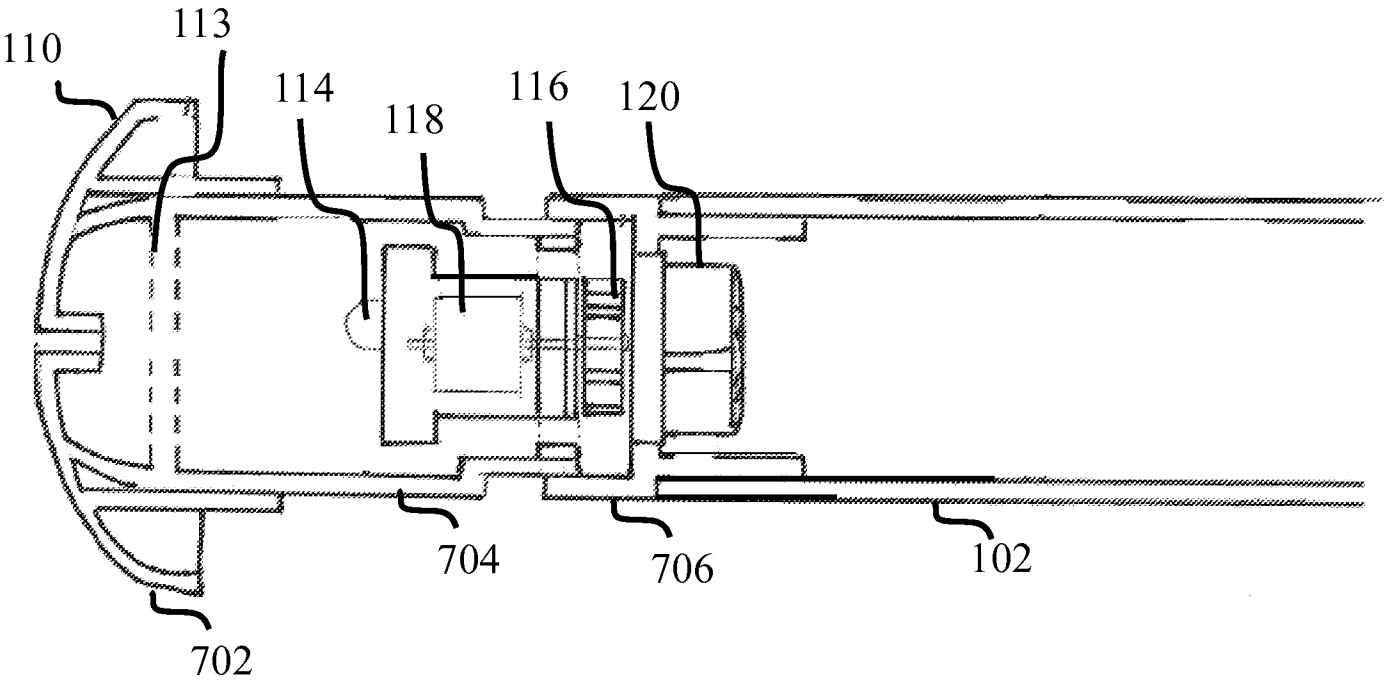
Figure 7C:
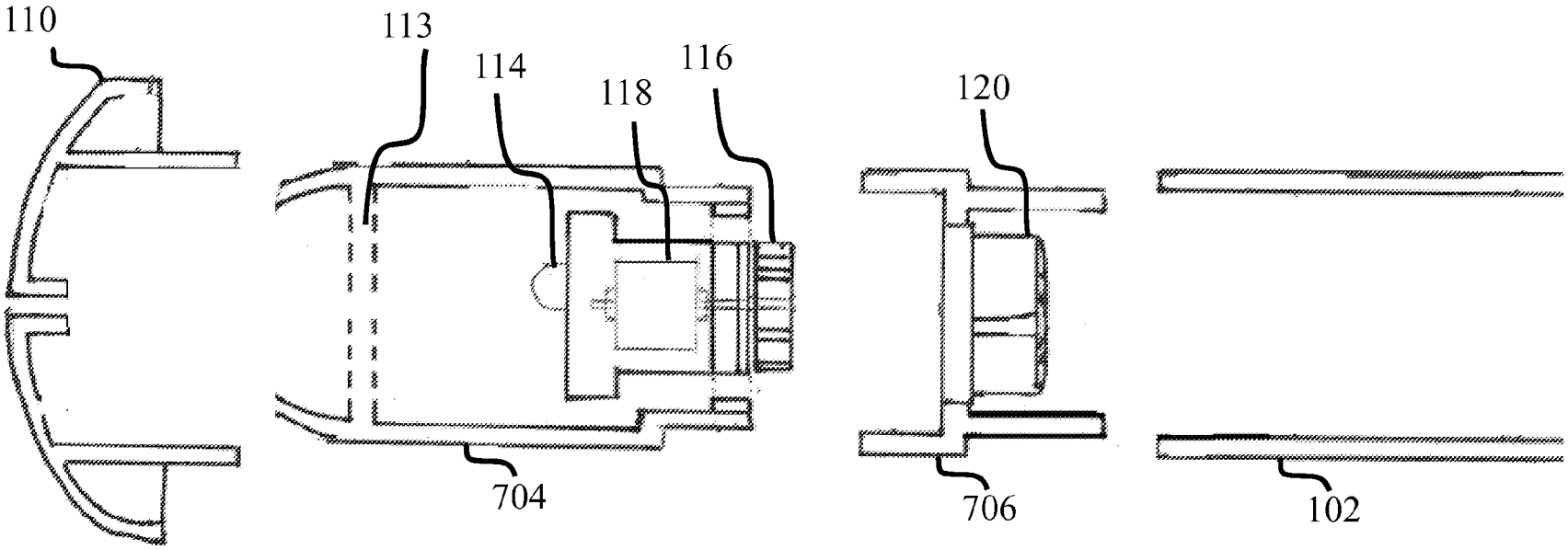

Referring to FIG. 7A, in exemplary embodiments, squirting toy 100 can include a turbulent control member 113 that can be used to decrease turbulent fluid (e.g., water) flow and/or increase laminar fluid (e.g., water) flow from the exit of nozzle 110. Further, in exemplary embodiments, squirting toy 100 can include an electrical generating assembly that can include, but is not limited to, a turbine assembly 116 (not shown) and/or a dynamo 118. Further still, in exemplary embodiments, squirting toy 100 can include a spiral generator or water flow deflector 120 that can direct the flow of water before interaction with turbine assembly 116 (not shown). By directing the flow of water before interaction with turbine assembly 116 (not shown), water flow director 120 can increase the efficiency of electricity generation by the electrical assembly.

Further, in exemplary embodiments, blades of turbine assembly 116 can be shaped with a pitch and/or angle so that axial flow of the fluid passing the blades causes rotational movement of turbine assembly 116 (not shown). For example, in some embodiments, water flow director 120 may not be required as blades of turbine assembly 116 (not shown) can be shaped to cause rotational movement of turbine assembly 116 (not shown). Of course, in some embodiments, water flow director 120 can be used in conjunction with blades of turbine assembly 116 to cause rotational movement of turbine assembly 116 (not shown).

Referring to FIGS. 7A-7D, in exemplary embodiments, turbulent control member 113, turbine assembly 116, dynamo 118, water flow director 120, nozzle 110, and/or housing 102 can be substantially separate assemblies, can be sub-assemblies that are combined, and/or can be assembled in any reasonable manner. For example, referring to FIG. 7A, turbulent control member 113, turbine assembly 116 (not shown), and/or dynamo 118 can substantially separate and/or can be located within housing 102 proximal to nozzle 110. For another example, referring to FIG. 7B, turbulent control member 113 can be included in nozzle sub-assembly 702 including turbine assembly 116 and/or dynamo 118, which in turn can be included in electrical generating sub-substantially 704.Water flow director 120 can be included in water flow director sub assembly 706. For yet another example, referring to FIG. 7C, turbulent control member 113, turbine assembly 116 and/or dynamo 118 can be included in electrical generating sub-substantially 704 and/or water flow director 120 can be included in water flow director sub assembly 706. It will be understood that, each of turbulent control member 113, turbine assembly 116, dynamo 118, water flow director 120, nozzle 110, and/or housing 102 can be further combined and/or separating without deviating from the scope of the disclosure.

Figure 7D:
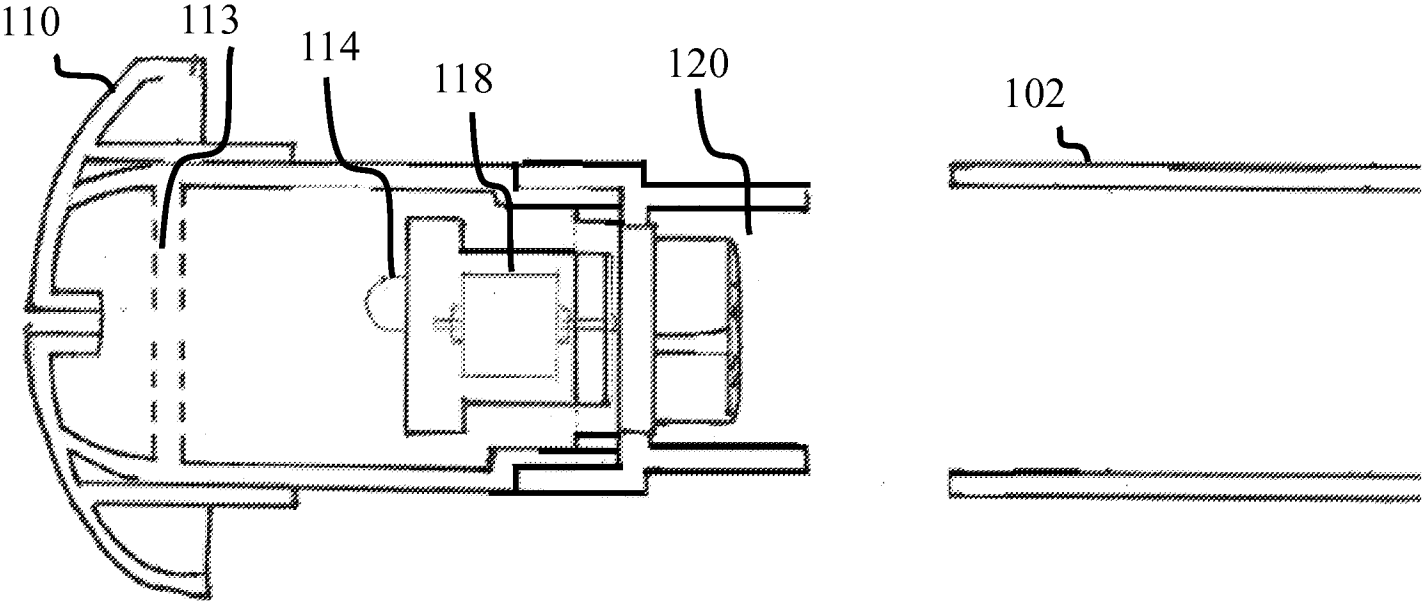

Referring to FIG. 7D, in exemplary embodiments, a sub-assembly and/or plurality of sub-assemblies can include turbulent control member 113, turbine assembly 116, dynamo 118, water flow director 120, and/or nozzle 110 such that the sub-assembly and/or plurality of sub-assemblies can be coupled to and/or housed in housing 102.

In exemplary embodiments, turbulent control member 113, turbine assembly 116, dynamo 118, water flow director 120, nozzle 110, housing 102, nozzle sub-assembly 702, electrical generating sub-substantially 704, and/or water flow director sub assembly 706 can include a coupling region. In exemplary embodiments, the coupling region of one component and/or sub-assembly can remain coupled to the coupling region of another component and/or sub-assembly by any reasonable interaction, such as, but not limited to, a mechanical interaction (e.g., thread interaction, frictional interaction, etc.), a chemical interaction (e.g., bonding, melting, etc.), an adhesive interaction (e.g., adhesively contacting the coupling regions), or any other reasonable interaction capable of coupling the coupling regions.

Referring to FIG. 8A, in exemplary embodiments, turbulent control member 113 can include a screen and/or mesh 802. Referring to FIG. 8B, in exemplary embodiments, turbulent control member 113 can include perforated plate 804. Referring to FIG. 8C, in exemplary embodiments, turbulent control member 113 can include linear guidance walls 806. Referring to FIG. 8D, in exemplary embodiments, turbulent control member 113 can include opening and/or hole in plate 804. In exemplary embodiments, turbulent control member 113 can include any construction that reduces turbulent flow, increases laminar flow, and/or produces a more concentrated stream, exiting from the squirting toy, capable of traversing substantially far distances.

In exemplary embodiments, turbulent control member 113 and nozzle 110 can be combined into substantially one unit and/or sub-assembly. For ease, at times, turbulent control member 113 and nozzle 110 are depicted and/or described as a single and/or plurality of units and/or sub-assemblies. This is merely for ease and is in no way meant to be a limitation.

In exemplary embodiments, nozzle 110 can include any construction that reduces turbulent flow, increases laminar flow, and/or produces a more concentrated stream, exiting from the squirting toy, capable of traversing substantially far distances. By way of example, the exit from nozzle 110 can include a tube substantially long enough to reduce turbulent flow, increase laminar flow, and/or produce a more concentrated stream, exiting from the squirting toy, capable of traversing substantially far distances.

Figure 9:
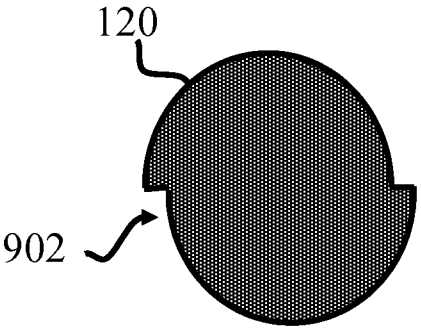
FIG. 9 depicts a water flow director of the systems and methods of the present invention.

Referring to FIG. 9, in exemplary embodiments, water flow director 120 can include any number of inlet guide vanes 902 that direct the flow of a fluid, for example, on to turbine assembly 116 (not shown). Inlet guide vanes 902 can include any shape such as, but not limited to, round, square, polygonal, triangular, star shaped, crescent shaped, or any other reasonable shape for directing the flow of a fluid (e.g., water). For ease, inlet guide vanes 902 are depicted as a single crescent shaped guide vane, this is in no way meant to be a limitation.

In exemplary embodiments, water flow director 120 can be a substantially flat circular object, substantially flat object having any reasonable shape, cone shaped, puck shaped, cap shaped, or any other reasonable shape. For ease, water flow director 120 is, at times, depicted as having a disc shape, this is in no way meant to be a limitation.

In exemplary embodiments, water flow director 120 can cover at least a portion of turbine assembly 116 (not shown) and include any number of inlet guide vanes 902 that can be tangential to the outermost surface of water flow director 120 such that guide vanes 902 can direct the flow of water driving the rotation of turbine assembly 116 (not shown). For example, water flow director 120 can be a cylindrical cover over at least a portion of turbine assembly 116 (not shown) having a series of guide vanes 902 that can be tangential to the outermost surface of the cylinder such that guide vanes 902 can direct to flow of water driving the rotation of turbine assembly 116 (not shown).

Figure 10:
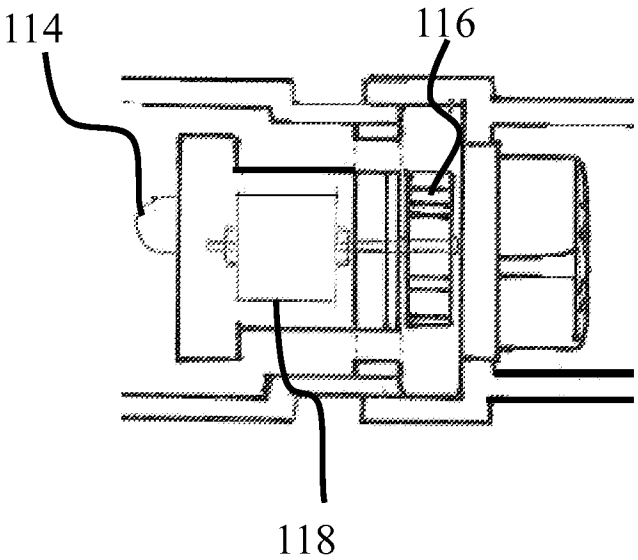
FIG. 10 depicts an electrical assembly and electric device of the systems and methods of the present invention.

Referring to FIG. 10, in exemplary embodiments, device 114 can include any electric device that is at least partially powered by electricity generated by dynamo 118 and/or powered in response to user driven fluid interaction with turbine assembly 116 causing rotation of the turbine. Electric device 114 can be, but is not limited to, a light source (e.g., an LED, light bulb, etc.), a noise generating device, and/or any form of electronic device.

In exemplary embodiments, dynamo 118 can be, but is not limited to, any electric generator and/or device that can convert mechanical energy (e.g., water flow) to electrical energy (e.g., direct current, alternating current, etc.) in response to fluid flow that, for example, is driven by a user's force on handle 107 (not shown) in turn driving a piston 104 (not shown).

In exemplary embodiments, turbine 116 can be, but is not limited to, Francis, Kaplan, Propeller, Bulb, Tube, Straflo, Tyson, Gorlov, waterwheel, pelton, turgo, crossflow, jonval turbine, reverse overshot water-wheel, Archimedes screw type, and/or any reasonable form of reaction and/or impulse turbine.

In exemplary embodiments, turbine 116 can be constructed to rotate in a single direction, two directions, and/or can include any reasonable construction. For example, turbine 116 can include blades at a pitch such that when a fluid traverses turbine 116 it rotates in a clockwise and/or counter clockwise direction. In exemplary embodiments, turbine 116 can be constructed such that water flow director 120 is not required and/or turbine 116 can be constructed such that water flow director 120 can be required and/or can increase the efficiency of electricity produced by the electrical assembly.

In exemplary embodiments, electric device 114 can be located substantially close to and/or be constructed to be a part of dynamo 118 and/or turbine 116. Locating electric device 114, dynamo 118, and/or turbine 116 substantially close to each other and/or constructing them to be part of a substantially closed unit can be done to decrease the risk of failure due to, for example, exposure to water.

Figure 11A:
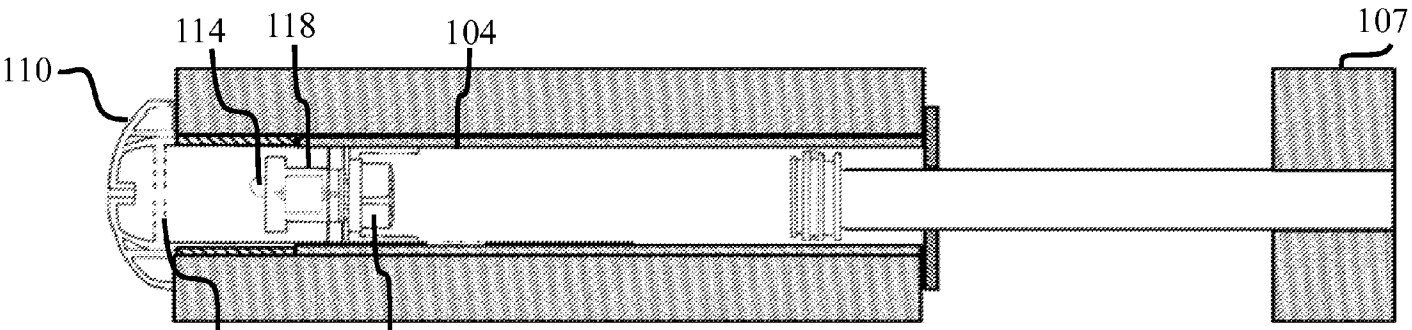
FIGS. 11A-11B depict the squirting toy in a substantially loaded and nearly exhausted position in accordance with the systems and methods of the present invention.
Figure 11B:
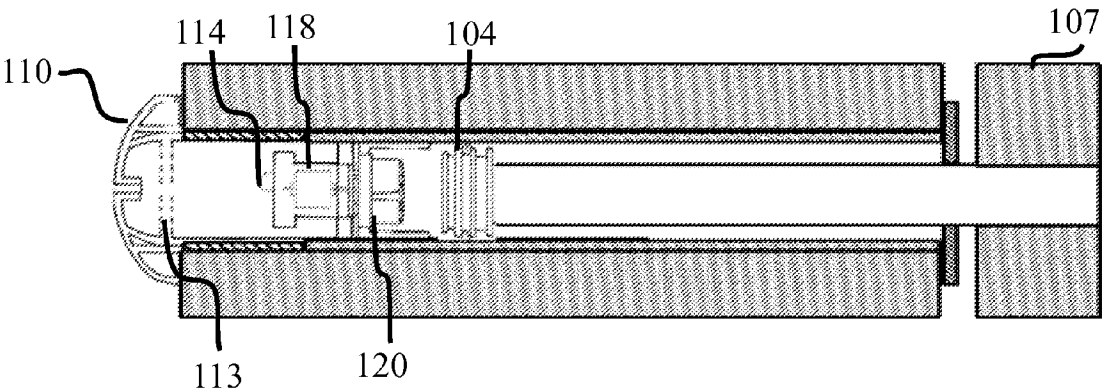

Referring to FIGS. 11A-11B, in exemplary embodiments, fluid can be exhausted from squirting toy 100 by, for example, slidably moving piston 104 inside housing 102 such that fluid contained in housing 102 can be forced towards nozzle 110. In exemplary embodiments, fluid exhausted from squirting toy 100 can be used to power electric device 116 by converting the mechanical movement of the water driven by piston 104 to electrical energy using the interaction of the water with turbine 116, for example, that can drive dynamo 118.

By way of example, referring to FIG. 11A water can be held in housing 102. Advancing piston 104 forward, referring to FIG. 11B, water can be forced towards nozzle 110. Prior to exiting nozzle 110 at least some of the water can traverse water flow director 120 such that at least some of the water can be directed by inlet guide vanes 902 in a direction that drives turbine 116. In exemplary embodiments, water driven by piston 104 traverses water flow director 120 and/or turbine 116 in a direction tangential to the direction piston 104 traverses and/or the direction the water is exhausted from nozzle 110.

Further, in exemplary embodiments, after water traverses water flow director 120 and/or turbine 116 the water can be substantially turbulent and can traverse turbulent control member 113 thereby reducing turbulent flow, increasing laminar flow, and/or producing a more concentrated exit stream, from squirting toy 100, capable of traversing substantially far distances.

In exemplary embodiments, a user can drive handle 107 thereby causing piston 104 to slidably move which can drive water across the electrical assembly (e.g., as described herein) and in turn cause electricity to be delivered to electric device 116 without the need for batteries. This can be beneficial for the environment and can reduce costs for the user.

In exemplary embodiments, powering electric device 116 in a manner described herein can act as an alert to the user and others that squirting toy 100 is being used; can reduce the size of the squirting toy, for example, by eliminating the need for a battery containment area or charging area; can be substantially well contained and/or insulated from fluids and can substantially reduce the risk of shorting out the electrical assembly; and, can provide the user with a substantial degree of control over the quantity of electricity delivered to the electric device because, for example, the user's translating of the piston drives electricity generation.

Now that exemplary embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

What is claimed is:

1. A squirting toy comprising:

a housing having a chamber, the housing comprising an interior surface and an exterior surface, a first end comprising an opening, and a second end comprising an opening;

a piston slidably engaged with the interior surface of the housing and connected to a shaft, the shaft extending from the second end of the housing and comprising a handle portion external to the housing, the piston being adapted for longitudinal movement within the chamber to decrease and increase the volume of the chamber such that water is inhaled through the first end when the volume increases and exhaled through the first end when the volume decreases;

a soft non-water-absorbing shell disposed over a portion of the external surface of the housing; and an electrical generating assembly powering an electric device, wherein electricity is generated by slidably moving the piston longitudinally within the chamber, wherein the water powers the electrical generating assembly.

2. The squirting toy of claim 1, wherein the electrical generating assembly is further comprising:

a turbine assembly; and a dynamo.

3. The squirting toy of claim 2, wherein the electrical generating assembly is further comprising:

a water flow director having an at least one guide vane that a fluid passes through; and wherein the water flow director directs the flow of the water before interaction with the turbine assembly.

4. The squirting toy of claim 3, wherein the water flow director directs the flow of water into a spiral flow pattern.

5. The squirting toy of claim 2, wherein slidably moving the piston along a length of the housing causes fluid to interact with the turbine assembly causing the turbine assembly to rotate and the dynamo to generate electricity.

6. The squirting toy of claim 1, further comprising:

a turbulent control member;

wherein the turbulent control member at least one of reduces turbulent flow, increases laminar flow, and produces a more concentrated exit stream, from the squirting toy, capable of traversing substantially far distances.

7. The squirting toy of claim 6, wherein the turbulent control member is at least one of a perforated plate, a screen member, and linear guidance walls.

8. The squirting toy of claim 1, wherein the electric device is at least one of a light source and noise generator.

9. The squirting toy of claim 1, wherein the soft non-water-absorbing shell is further comprising:

providing buoyancy to keep the toy afloat in water when the housing is filled to a maximum capacity with water;

forming a protective surface over at least a portion of the housing; and whereby the softness of the shell offers safety benefits.

10. The squirting toy of claim 1, wherein the soft non-water-absorbing shell is disposed over substantially the entirety of the housing.

11. The squirting toy of claim 1, further comprising a soft non-water-absorbing shell disposed over a portion of the handle portion.

12. The squirting toy of claim 9, wherein the safety benefits comprise at least one of softness and absence of hard edges.

13. An electrical generating assembly for a squirting toy, comprising:

an electrical generating assembly powering an electric device, the electrical generating assembly comprising a turbine assembly and a dynamo, the electrical generating assembly coupled to a distal end of a housing of a squirting toy;

a nozzle coupled to a distal end of the electrical generating assembly;

the housing having a chamber of variable volume, the volume being varied by user driven force causing water to be inhaled and exhausted through the nozzle such that the water traverses the electrical generating assembly;

wherein electricity is generated by water traversing the electrical generating assembly in response to the volume of the chamber being varied by the user.

14. The electrical generating assembly for a squirting toy of claim 13, wherein the electrical generating assembly is further comprising:

a water flow director having an at least one guide vane that a fluid passes through; and wherein the water flow director directs the flow of the water before interaction with the turbine assembly.

15. The electrical generating assembly for a squirting toy of claim 14, wherein the water flow director directs the flow of water into a spiral flow pattern.

16. The electrical generating assembly for a squirting toy of claim 13, further comprising:

a turbulent control member;

wherein the turbulent control member at least one of reduces turbulent flow, increases laminar flow, and produces a more concentrated exit stream, from the squirting toy, capable of traversing substantially far distances.

17. The electrical generating assembly for a squirting toy of claim 16, wherein the turbulent control member is at least one of a perforated plate, a screen member, and linear guidance walls.

18. The electrical generating assembly for a squirting toy of claim 13, wherein the electric device is at least one of a light source and noise generator.

19. The electrical generating assembly for a squirting toy of claim 13, wherein the housing is further comprising:

an external surface, an internal surface, a fluid flow end, and a shaft receiving end.

20. The electrical generating assembly for a squirting toy of claim 19, wherein:

(i) the volume of the chamber increases, inhaling fluids through the nozzle, when a piston slidably engaged with the internal surface of the chamber moves in a first lateral direction towards the shaft receiving end, and (ii) the volume of the chamber decreases, exhaling fluids through the nozzle, when the piston slidably engaged with the internal surface of the chamber moves in a second lateral direction towards the fluid flow end.

21. The electrical generating assembly for a squirting toy of claim 19, wherein a soft non-water-absorbing shell disposed over a portion of the external surface of the housing.

22. The electrical generating assembly for a squirting toy of claim 21, wherein the soft non-water-absorbing shell is further comprising:

providing buoyancy to keep the toy afloat in water when the housing is filled to its maximum capacity with water;

forming a protective surface over at least a portion of the housing; and whereby the softness of the shell offers safety benefits.

23. The electrical generating assembly for a squirting toy of claim 21, wherein the soft non-water-absorbing shell is disposed over substantially the entirety of the housing.

24. The electrical generating assembly for a squirting toy of claim 21, further comprising a soft non-water-absorbing shell disposed over a portion of the handle portion.

25. The electrical generating assembly for a squirting toy of claim 21, wherein the safety benefits comprise at least one of softness and absence of hard edges.

26. A water squirting toy having a housing including a nozzle end and a variable volume chamber, the chamber volume being varied by user driven force on a handle causing a piston to slidably traverse longitudinally within the chamber increasing and decreasing the volume of the chamber thereby causing water to be inhaled and exhausted through the nozzle of the water squirting toy wherein the improvement comprises an electrical generating assembly powering an electric device, wherein electricity is generated by the piston slidably traversing longitudinally within the chamber, wherein the water powers the electrical generating assembly during at least one of inhalation and exhaustion of water from the squirting toy.

* * * * *